United States Patent [19]

Zuckerman et al.

[11] Patent Number: 4,988,110

[45] Date of Patent: Jan. 29, 1991

[54] COMBINATION BOARD GAME AND WRAPPER FOR EDIBLE PLAY PIECES

[75] Inventors: Ronald K. Zuckerman, Minnetonka; Gregory J. McAfee, Eagan, both of Minn.

[73] Assignee: Grist Mill Company, Lakeville, Minn.

[21] Appl. No.: 453,844

[22] Filed: Dec. 20, 1989

[51] Int. Cl.[5] ..... A63F 3/00; A63F 3/02; B65D 65/46

[52] U.S. Cl. ..... 273/286; 273/287; 273/288; 273/260; 229/87.01; 229/87.08

[58] Field of Search ..... 273/287, 286, 288, 249, 273/153 R, 248, 1 R, 146, 260, 247; 446/491; 206/800; 229/87 G, 904.1, 87 F, 87 R

[56] References Cited

U.S. PATENT DOCUMENTS

| | | | |
|---|---|---|---|
| 3,100,642 | 8/1963 | Goldstein | 273/287 |
| 3,191,184 | 6/1965 | Durstewitz | 273/249 |
| 3,948,528 | 4/1976 | Goodman et al. | 273/286 |
| 4,140,317 | 2/1979 | Ramney | 273/287 |
| 4,696,473 | 9/1987 | Wyzykowski | 273/153 R |

OTHER PUBLICATIONS

There's a Brand New Game in Town by Nick Adde, Fairfax Journal, Nov. 3, 1981, pp. B1, B3.

*Primary Examiner*—Benjamin Layno
*Attorney, Agent, or Firm*—Fleit, Jacobson, Cohn, Price, Holman & Stern

[57] ABSTRACT

A combination candy wrapper and board game. The candy wrapper has board game indicia printed on its outside surface. The wrapper is initially sealed. Edible playing pieces, candy, are contained within the sealed wrapper. In order to play the board game, the wrapper is opened and the edible playing pieces are removed therefrom. The wrapper body is then deployed as a flat sheet converting the wrapper body into a game board. The edible playing pieces are then used in conjunction with the game board to play the game. A box for packaging several units of package wrapper/board games is provided.

33 Claims, 5 Drawing Sheets

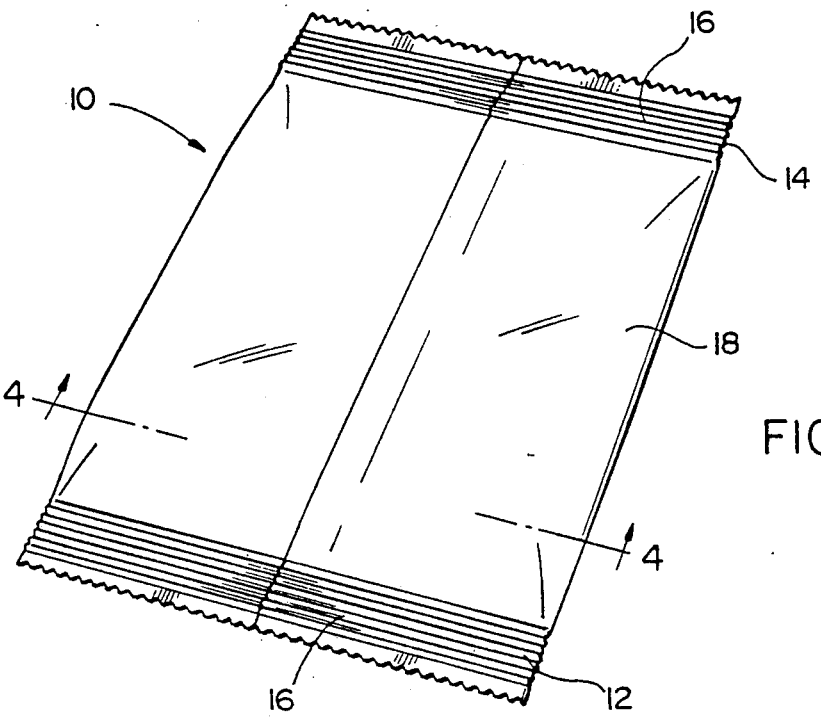
FIG. 3
FIG. 4
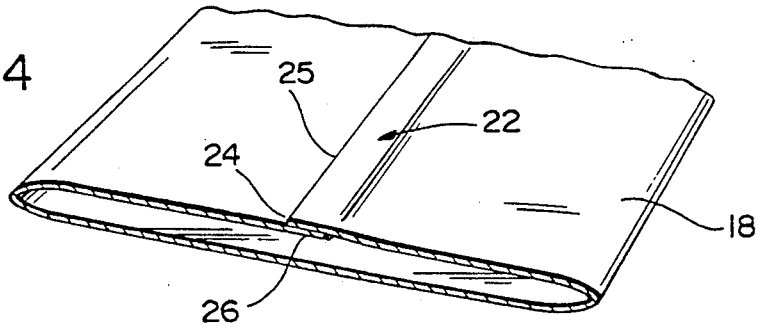
FIG. 5
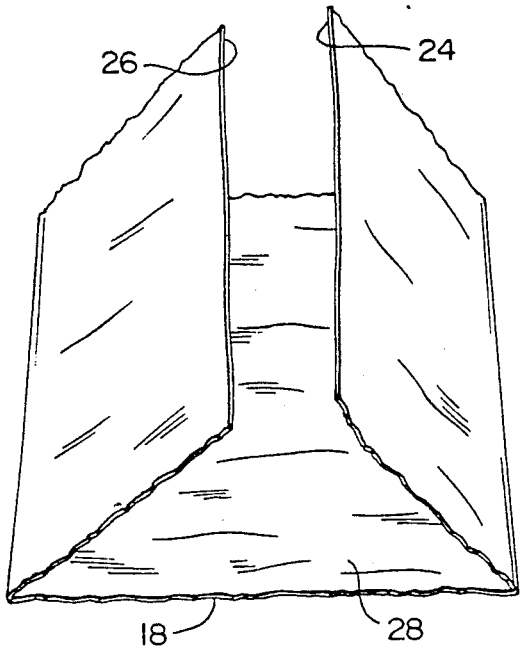

COMBINATION BOARD GAME AND WRAPPER FOR EDIBLE PLAY PIECES

BACKGROUND OF THE INVENTION

The present invention relates to a board game wherein the playing board serves as the wrapper for edible play pieces.

Package wrappers for small edible items often have attractive designs and advertisements printed thereon. For example, candy wrappers usually have a trademark or other brand name printed thereon.

According to the present invention, the package wrapper is used for other purposes. Because small children often are the target consumers of certain candy items, the use of the wrapper for additional purposes, for example, as an educational medium or as a game, is appealing.

SUMMARY OF THE INVENTION

It is a primary object of the present invention to provide a combination candy wrapper and board game.

It is yet another object of the present invention to provide a combination candy wrapper and board game wherein the wrapper contains edible items which are used as pieces in the board game.

It is an additional object of the present invention to provide a combination candy wrapper and board game which is easy to use and can serve for many types of board games.

It is yet a further object of the present invention to provide a combination wrapper and board game for containing edible play pieces relating to use with the board game.

It is yet a further object of the present invention to provide a packaging container for packaging a plurality of combination candy wrappers and board games.

According to the present invention, a combination candy wrapper and board game is provided having a board game and instructions printed on the exterior of the wrapper. The wrapper contains player pieces which are edible and are used for playing the board game.

The wrapper comprises a body portion with two tear off end tabs and a separable seam extending longitudinally across the wrapper. The two end tabs are torn off to allow access to the contents of the wrapper. The seam is separated so that the wrapper is deployed as a flat sheet with the instructions and the game board facing upwards.

The combination candy wrapper and board game is preferably sold in a plurality of units. Therefore, a container is provided for packaging a plurality of units; the units can have the same or different board games printed thereon.

The above and other objects and advantages of the present invention will become more readily apparent when reference is made to the following description taken in conjunction with the accompanying drawings.

BRIEF DESCRIPTION OF THE DRAWINGS

FIG. 3 is a perspective view of the combination candy wrapper and board game.

FIG. 4 is a cross-sectional view taken through line 4—4 of FIG. 3.

FIG. 5 is a perspective view illustrating the candy wrapper in the final stages of deployment into a board game.

DETAILED DESCRIPTION OF THE DRAWINGS

Figure 1:
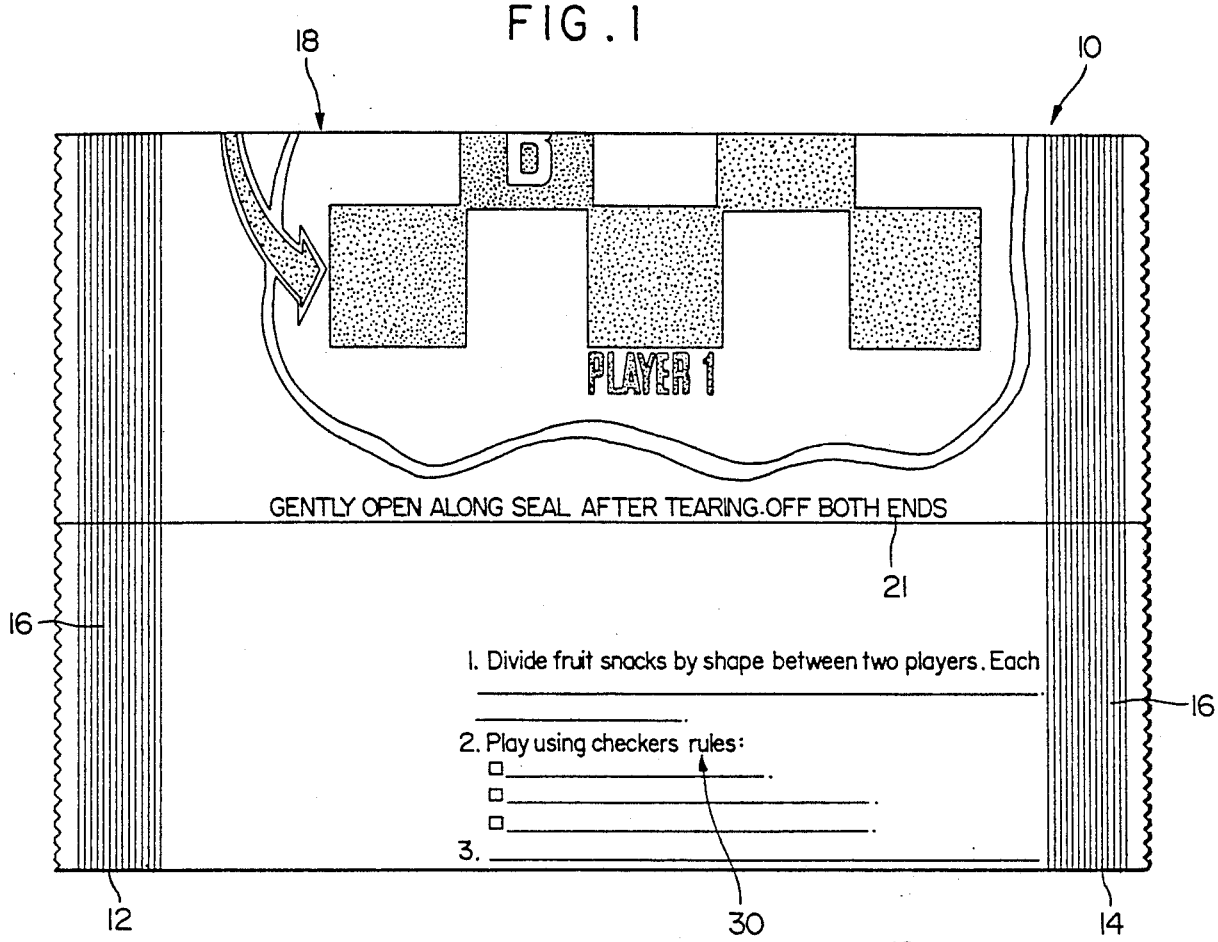
FIG. 1 is a top view of one of the sides of the combination candy wrapper and board game according to the present invention.
Figure 2:
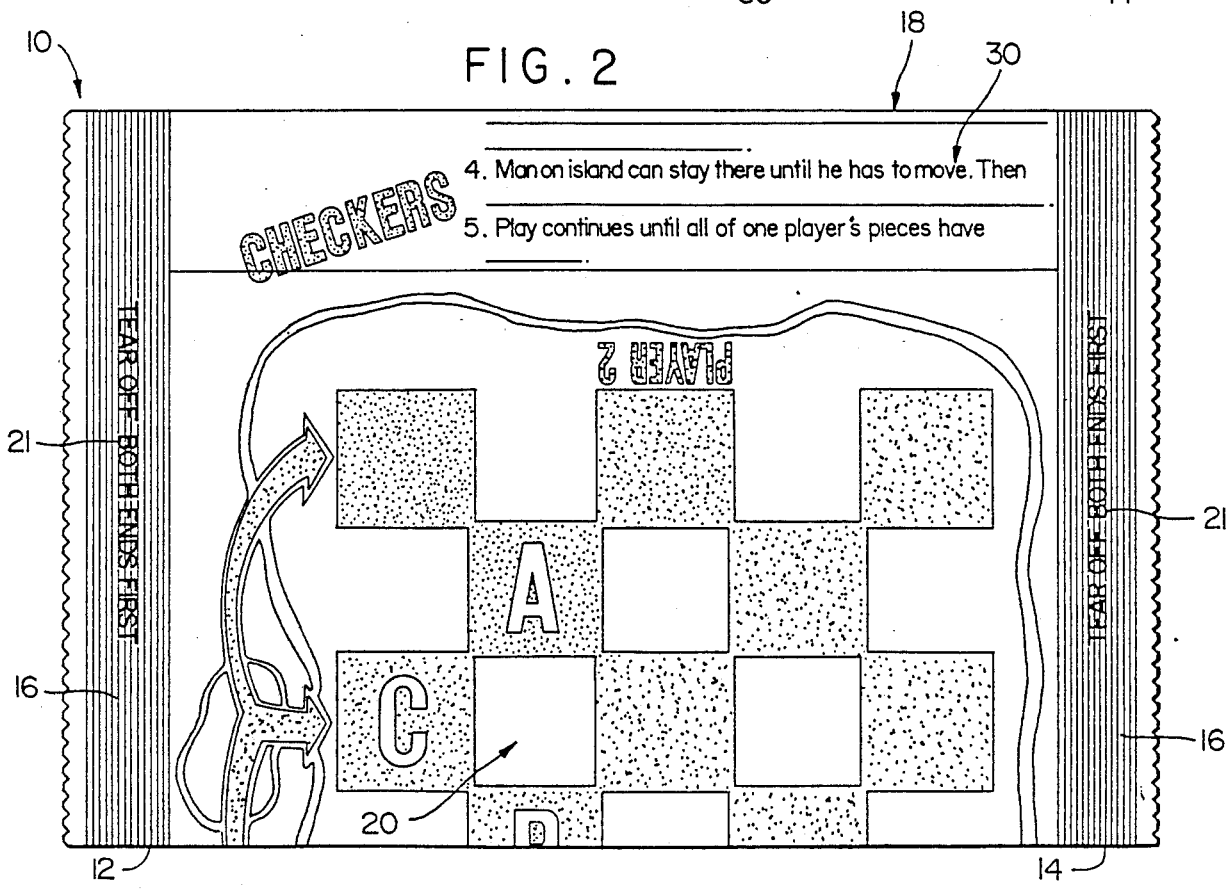
FIG. 2 is a top view of the other side of the combination candy wrapper and board game according to the present invention.

Referring first to FIGS. 1–3, the combination wrapper and board game according to the present invention is generally shown at 10. The wrapper 10 comprises a body portion 18 and end tab portions 12 and 14. The end tabs include a plurality of ridges 16 formed by sealing the body portion, as is well known in the art.

The body portion 18 has a board game 20 printed thereon together with instructions 30 for playing the board game 20. In addition, deployment instructions 21 are provided on the wrapper 10 to assist in the opening of the wrapper 10 and deploying of the wrapper 10 into its board game form.

FIG. 4 generally illustrates the manufacturing of the wrapper 10. The wrapper 10 is manufactured by folding a sheet of wrapping material to form a sleeve and sealing the ends 24 and 26 of the sheet together to form a seam 22 with the end 24 positioned to overlap the end 26, thus forming a seam tab 25. The sleeve is also sealed at its open ends to form the end tabs 12 and 14.

The first step in deploying the wrapper 10 into its board game form is to tear off and remove the end tabs 12 and 14. Access is provided to the contents of the wrapper 10 by the removal of at least one of the end tabs 12 or 14. After the end tabs 12 and 14 are removed, the seam 22 is carefully separated via the seam tab 25 so that the wrapper 10 takes the form illustrated in FIG. 5. The two ends 24 and 26 are separated so that the wrapper 10 can be deployed on a flat surface. In addition, FIG. 5 illustrates the interior surface of the body 18 of the wrapper 10. This inner surface 28 is a plastic coated aluminum foil for maintaining the freshness of the contents of the wrapper 10.

Figure 6:
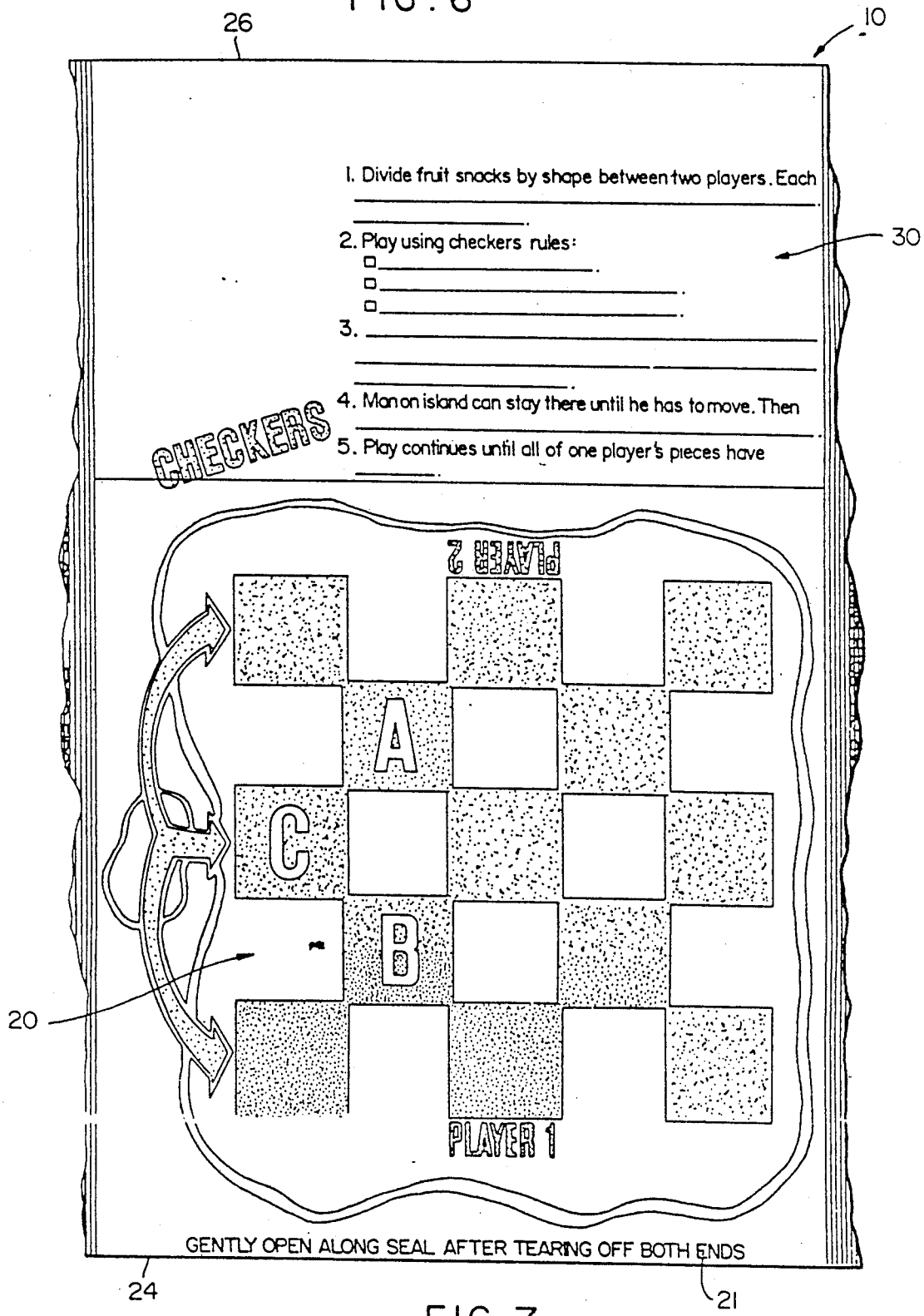
FIG. 6 is a top view of the combined candy wrapper and board game in its deployed state.

Referring now to FIG. 6, the wrapper 10 is shown in its final deployed state forming a playing surface for the board game 20.

Figure 7:
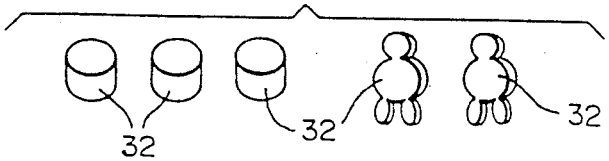
FIG. 7 is an illustration of the edible play pieces contained in the combined candy wrapper and board game.

FIG. 7 illustrates the edible candy play pieces 32 which are contained within the wrapper and are used for playing the game. The play pieces 32 are configured of character relating to the board game 20 and are designed to be played on the game board 20. For example, the shape of the pieces 32 are of character particularly for use with the game board 20 such as shown in FIG. 6, where the board game 20 is checkers in the theme of pirates, and consequently, the play pieces 32 may be red and black checkers or colored pirate figures.

The details of the specific board game 20 shown in FIG. 6 is not considered to be a particular feature of the present invention though the candy play pieces 32 and the insignia on the wrapper are related in theme or character to the board game 20. The instructions 30 on the wrapper 10 provide adequate explanation for playing the board game 20 with the candy play pieces 32.

Figure 8:
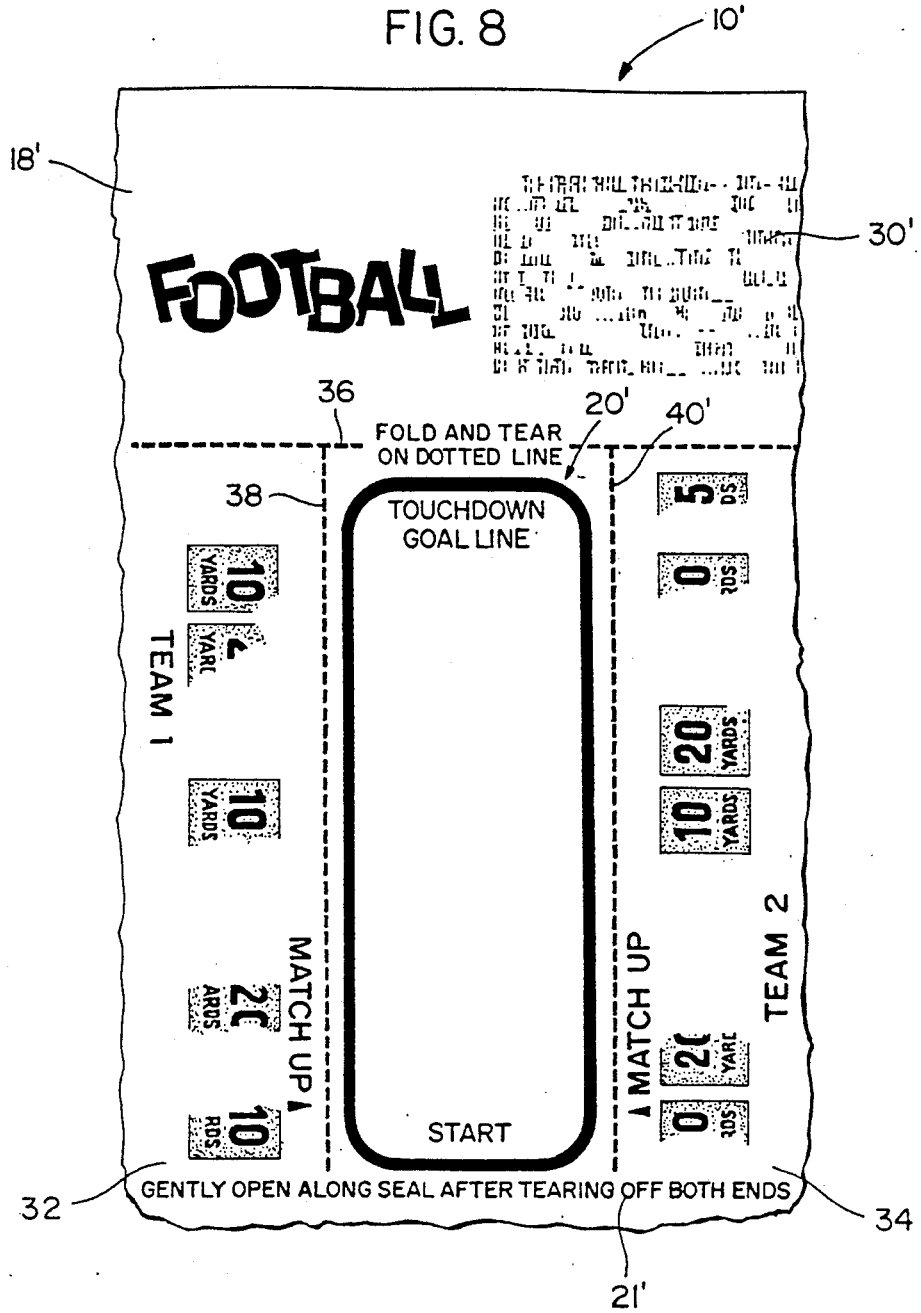
FIG. 8 is a top view of the combined candy wrapper and board game and illustrating an additional type of board game according to the present invention.

FIG. 8 illustrates a combined wrapper and board game 10' according to a modified form of the present invention. In this form, the body 18' includes tear away portions 32 and 34 which are used to play the board game 20'. The tear away portions 32 and 34 are defined by dotted lines 36, 38, and 40 indicated by instruction 41 printed on the body 18'.

Figure 9:
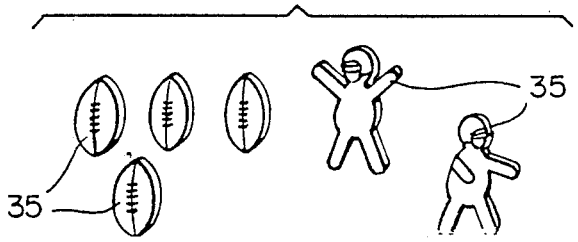
FIG. 9 is an illustration of the edible play piece for use with the board game of the wrapper illustrated in FIG. 8.
Figure 10:
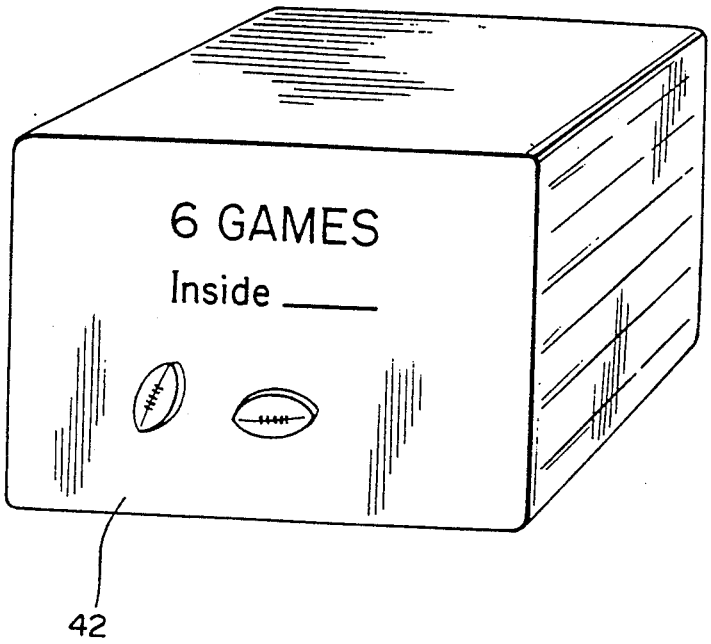
FIG. 10 is a perspective view of a container for packaging a plurality of units of the combination candy wrapper and board game.

Similar to FIG. 7, FIG. 9 shows the play pieces 35 shaped as footballs or football players for use with the board game 20' of wrapper 10'. The pieces 35 are colored for distinguishing between players, like candy play pieces 32.

The combined wrapper and board game according to the present invention gives function to the wrapper and allows a user to play the board game printed on the wrapper with or without any other materials. The wrapper is used to both contain edible player pieces used in playing the game and as a surface for which the board game is printed thereupon. Further, instructions in both deploying the wrapper into a board game and for playing the board game are printed on the wrapper. The board game printed on the wrapper relates in theme or character to the edible pieces contained therein in character such as shape.

Preferably, the combination wrapper and board game is sold in a plurality of units, each having a different game board printed thereon. Therefore, a container shown at 42 in FIG. 9 is provided. The container 42 is labelled to indicate the number of units contained therein and also includes indicia representing features of each of the board games on each of the units.

While the material forming the wrapper is not considered an essential feature of the present invention, typical candy wrapping material is appropriate and a wrapping paper with an inner surface of plastic coated foil enabling easy opening and deployment is preferred.

The above description is intended by way of example only and is not intended to limit the present invention in any way except as set forth in the following claims.

What is claimed is:

1. A combination wrapper and board game for containing a plurality of edible pieces for use with the board game, said combination comprising:

a sealed wrapper body formed from a sheet of wrapping material having an inner surface and an outer surface;

board game indicia printed on the outer surface of said wrapping material so that said wrapper body is deployable as a flat sheet for converting said wrapper body into a board game; and means defining play pieces sealed within said wrapper body in contact with said inner surface for use in combination with said board game indicia.

2. The combination wrapper and board game of claim 1, wherein said sealed wrapper body comprises a seam formed by joining opposite ends of a sheet of said wrapping material to form a sleeve having open ends, and tear off end tabs formed by sealing said sleeve at said open ends, so that said sealed wrapper body can be deployed flat by removing said tear off end tabs and separating said seam.

3. The combination wrapper and board game of claim 2, and further comprising a seam tab formed at said seam by slightly overlapping one of said opposite ends of said sheet of wrapping material.

4. The combination wrapper and board game of claim 1, wherein said means defining play pieces comprises edible play pieces which have a relation to said board game.

5. The combination wrapper and board game of claim 3, wherein said relation is the shape of said play pieces.

6. The combination wrapper and board game of claim 4, wherein said play pieces have a characteristic for distinguishing said pieces into groups of pieces, each of said groups corresponding to the play pieces for a particular player.

7. The combination wrapper and board game of claim 6, wherein said characteristic is color.

8. The combination wrapper and board game of claim 1, wherein said wrapper body includes tear away strip portions defined by dotted lines printed on the outer surface of said sheet, said tear away strips having indicia printed thereon for use with said board game.

9. A combination wrapper and board game comprising:

a plurality of edible play pieces having a particular play characteristic;

a wrapper for containing said edible pieces comprising a sealed wrapper body formed from a sheet of wrapping material; said sheet of wrapping material having an inner surface and an outer surface, said inner surface being in contact with said play pieces, and;

board game indicia relating to said play characteristic of said play pieces printed on the outer surface of said wrapping material so that said wrapper can be deployed as a flat sheet for converting said wrapper into a board game.

10. The combination wrapper and board game of claim 9, wherein said sealed wrapper body comprises a seam formed by joining opposite ends of a sheet of said wrapping material to form a sleeve having open ends, and tear off end tabs formed by sealing said sleeve at said open ends, so that said sealed wrapper body can be deployed flat by removing said tear off end tabs and separating said seam.

11. The combination wrapper and board game of claim 10, and further comprising a seam tab formed at said seam by slightly overlapping one of said opposite ends of said sheet of wrapping material.

12. A method of manufacturing a combination wrapper and board game for use with edible pieces contained therein, comprising:

printing indicia of a board game together with playing instructions on an outer surface of a sheet of wrapping material;

placing edible means defining game playing pieces within said sheet in contact with an inner surface of the sheet; and sealing said sheet of wrapping material to form a sealed wrapper body.

13. The method of claim 12, and further comprising the steps of:

folding opposite ends of a sheet of said wrapping material towards each other to form a sleeve having open ends;

forming a seam by sealing said opposite ends together; and sealing said open ends.

14. The method of claim 12, wherein said step or printing indicia is such that said edible pieces are of shapes which relate to the indicia of said board game.

15. A combination wrapper and board game and a container for containing a predetermined number of said combination wrapper and board games for sale, said combination wrapper and board game comprising:

sealed wrapper body formed from a sheet of wrapping material;

board game indicia printed on an outer surface of said wrapping material so that said wrapper body is deployable as a flat sheet for converting said wrapper body into a board game; and means within said wrapper body, contacting an inner surface of said material, for use as playing pieces in combination with said board game indicia.

16. The combination wrapper and board game of claim 15, wherein said sealed wrapper body comprises a seam formed by joining opposite ends of a sheet of said wrapping material to form a sleeve having open ends, and tear off end tabs formed by sealing said sleeve at said open ends, so that said sealed wrapper body can be deployed flat by removing said tear off end tabs and separating said seam.

17. The combination of claim 15, and further comprising indicia printed on said container relating to said board game indicia and said predetermined number of said combination wrapper and board games.

18. A method of manufacturing a combination wrapper and board game for use with edible pieces contained therein, and packaging a predetermined number of said combinations, the method comprising:

printing indicia of a board game together with the playing instructions on wrapping material;

placing edible means for use as playing pieces for said board game within the wrapping material;

sealing said wrapping material to form a sealed wrapper body containing said edible means in contact with an inner surface of the wrapping material; and packaging a predetermined number of units of said combination wrapper and board game in a container for sale of said predetermined number of units.

19. The method of claim 18, and further comprising the steps of:

folding opposite ends of a sheet of said wrapping material towards each other to form a sleeve having open ends;

forming a seam by sealing said opposite ends together; and sealing said open ends.

20. The method of claim 18, and further comprising the step of labeling the outside of said container with indicia corresponding to the board game indicia printed on said wrapper and said predetermined number of said combination wrapper and board games.

21. The method of claim 18, wherein each of said predetermined number of units of combination wrapper and board game has different board game indicia printed thereon and further comprising the step of labeling the outside of said container with each of said board game indicias.

22. The method of claim 18, wherein said step of printing indicia is such that said edible play pieces are of shapes which relate to the indicia of said board game.

23. A method of playing a combined wrapper and board game wherein a wrapper sheet having an internal surface wraps playing pieces in contact with the internal surface and a playing board is formed on an external surface of the wrapper sheet by printing indicia thereon, the method comprising the steps of:

opening the wrapper sheet on which the playing board is printed to expose the playing pieces.

removing the playing pieces from the opened wrapper;

deploying said wrapper as a flat sheet to form a game board; and playing a board game by utilizing said playing pieces on said game board.

24. The method of claim 23, wherein said step of deploying comprises tearing off end tabs of said wrapper and separating a seam of said wrapper.

25. A combination wrapper and board game for containing a plurality of edible play pieces for use with the board game, said combination comprising:

a sealed wrapper body formed from wrapping material;

board game indicia printed an outer surface of said wrapping material so that said wrapper body is deployable as a flat sheet for converting said wrapper body into a board game, wherein said sealed wrapper body comprises a seam formed by joining opposite ends of a sheet of said wrapping material to form a sleeve having open ends, and tear-off end tabs formed by sealing said sleeve at said open ends, so that said sealed wrapper body can be deployed flat by removing said tear-off end tabs and separating said seam.

26. The combination wrapper and board game of claim 25, and further comprising a seam tab formed at said seam by slightly overlapping one of said opposite ends of said sheet of said wrapping material.

27. A combination wrapper and board game for containing a plurality of edible play pieces for use with the board game, said combination comprising:

a sealed wrapper body formed from wrapping material;

board game indicia printed on an outer surface of said wrapping material so that said wrapper body is deployable as a flat sheet for converting said wrapper body into a board game, wherein said wrapper body includes tear away strip portions defined by dotted lines printed on the outer surface of said sheet, said tear away strips having indicia printed thereon for use with said board game.

28. A combination wrapper and board game comprising:

a plurality of edible play pieces having a particular play characteristic;

a wrapper for containing said edible pieces comprising a sealed wrapper body formed from a sheet of wrapping material;

board game indicia relating to said play characteristic of said play pieces printed on the outer surface of said wrapping material so that said wrapper can be deployed as a flat sheet for converting said wrapper into a board game, wherein said sealed wrapper body comprises a seam formed by joining opposite ends of a sheet of said wrapping material to form a sleeve having open ends and tear off end tabs formed by sealing said sleeve at said open ends, so that said sealed wrapper body can be deployed flat by removing said tear-off end tabs and separating said seam.

29. The combination wrapper and board game of claim 28 and further comprising a seam tab formed at said seam by slightly overlapping one of said opposite ends of said sheet of wrapping material.

30. A method of manufacturing a combination wrapper and board game for use with edible pieces contained therein, comprising:

printing indicia of a board game together with playing instructions on wrapping material;

sealing said sheet of wrapping material to form a sealed wrapper body;

folding opposite ends of a sheet of said wrapping material towards each other to form a sleeve having open ends;

forming a seam by sealing said opposite ends together; and sealing said open ends.

31. In combination, a combination wrapper and board game and a container for containing a predetermined number of said combination wrapper and board games for sale, said combination wrapper and board game comprising:

a sealed wrapper body formed from wrapping material;

board game indicia printed on an outer surface of said wrapping material so that said wrapper body is deployable as a flat sheet for converting said wrapper body into a board game, wherein said sealed wrapper body comprises a seam formed by joining opposite ends of a sheet of said wrapping material to form a sleeve having open ends, and tear off end tabs formed by sealing said sleeve at said open ends, so that said sealed wrapper body can be deployed flat by removing said tear off end tabs and separating said seam.

32. A method of manufacturing a combination wrapper and board game for use with edible pieces contained therein and packaging a predetermined number of said combinations, the method comprising the steps of;

printing indicia of a board game together with playing instructions on wrapping material;

sealing said wrapping material to form a sealed wrapper body;

packaging a predetermined number of units of said combination wrapper and board game in a container for sale of said predetermined number of units;

folding opposite ends of a sheet of said wrapping material towards each other to form a sleeve having open ends;

forming a seam by sealing said opposite ends together; and sealing said open ends.

33. A method of playing a combined wrapper and board game wherein a wrapper wraps playing pieces and a playing board is formed from the wrapper by printing indicia thereon, the method comprising the steps of;

opening a wrapper on which a playing board is printed to expose playing pieces;

removing playing pieces from the open wrapper;

deploying said wrapper as a flat sheet to form a game board;

playing a board game by utilizing said playing pieces on said game board; and wherein said step of deploying comprises tearing off end tabs of said wrapper and separating a seam of said wrapper.

* * * * *